US007819511B2

(12) United States Patent
Cheng et al.

(10) Patent No.: US 7,819,511 B2
(45) Date of Patent: Oct. 26, 2010

(54) APPARATUS FOR REGULATING AIR PRESSURE IN INK TANK AND INK-SUPPLYING SYSTEM HAVING THE SAME

(75) Inventors: Chen-Hsing Cheng, Hsinchu (TW); Tsung-Yu Hung, Hsinchu (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 570 days.

(21) Appl. No.: 11/871,929

(22) Filed: Oct. 12, 2007

(65) Prior Publication Data

US 2008/0259138 A1 Oct. 23, 2008

(30) Foreign Application Priority Data

Apr. 20, 2007 (TW) ..... 96113925 A

(51) Int. Cl.
*B41J 2/175* (2006.01)

(52) U.S. Cl. ..... 347/85; 347/86; 347/92

(58) Field of Classification Search ..... 347/85, 347/86, 89, 92
See application file for complete search history.

(56) References Cited

U.S. PATENT DOCUMENTS

| | | | | |
|---|---|---|---|---|
| 6,082,851 | A * | 7/2000 | Shihoh et al. | 347/85 |
| 6,561,637 | B2 * | 5/2003 | Hino | 347/92 |
| 7,399,075 | B2 * | 7/2008 | Nomura et al. | 347/89 |
| 2004/0090501 | A1 * | 5/2004 | Yoshida et al. | 347/85 |
| 2004/0196339 | A1 * | 10/2004 | Kobayashi et al. | 347/85 |
| 2007/0146448 | A1 * | 6/2007 | Chung et al. | 347/86 |

FOREIGN PATENT DOCUMENTS

| | | |
|---|---|---|
| CM | 02290847.1 | 12/2003 |
| CN | 1478657 | 3/2004 |

* cited by examiner

*Primary Examiner*—Ellen Kim
(74) *Attorney, Agent, or Firm*—Jeffrey T. Knapp

(57) ABSTRACT

The present invention relates to an apparatus (10) for regulating air pressure in an ink tank (14). The apparatus includes a vacuum pump (12) configured for providing a pressure below atmospheric pressure in the ink tank. A first regulating unit (16), a second regulating unit (18), and a third regulating unit (20) are disposed between the vacuum pump and the ink tank, and in communication with each other. The first regulating unit and the third regulating unit each include a pressure regulating valve and a buffer tank connected with the pressure regulating valve, and the second regulating unit includes a closed-loop pressure regulating valve (180) and a buffer tank (182) connected with the closed-loop pressure regulating valve.

8 Claims, 2 Drawing Sheets

APPARATUS FOR REGULATING AIR PRESSURE IN INK TANK AND INK-SUPPLYING SYSTEM HAVING THE SAME

BACKGROUND

1. Technical Field

The present invention generally relates to an ink-jet system, particularly, to an apparatus for regulating air pressure in an ink tank and an ink-supplying system having the same.

2. Description of the Related Art

A liquid crystal display typically utilizes a color filter to display images and graphs. The color filter is constructed by arranging the colored portions, which are colored in red (R), green (G), and blue (B), as three primary colors of light on a transparent substrate. A dyeing method, a pigment dispersing method, an electrodepositing method, and the like are generally used as manufacturing methods for the color filter. Recently, an ink jet method has been used.

The ink jet method is different from other conventional methods and is a method in which each of R, G, and B inks are sprayed onto a substrate from respective nozzles of an ink-jet device to form a color layer. When this method is employed, the required amount of ink can be applied onto a required area at a specific time. Accordingly, there is no waste of ink. Furthermore, since the sub-pixels of R, G, and B can be formed simultaneously, the printing process is shortened, and it is possible to markedly reduce cost.

Generally, the ink-jet device includes at least one print head. The at least one print head includes a plurality of nozzles. A respective nozzle connects to a respective ink reservoir configured for containing ink supplied by an ink tank.

The print head has certain disadvantages to its own. For example, when the print head is not in use, ink will sink out from the nozzles. To resolve this problem, a vacuum pump is usually used to maintain an air pressure in the ink tank below atmospheric pressure (i.e., substantially less than 760 mm Hg), in order to prevent the ink from sinking out from the nozzles. However, the vacuum pump is likely to create a concussive/fluctuated pressure, which affects the degree of vacuum in the ink tank. As a result, size of ink droplets becomes unstable, thus the quality of color filter made by the ink-jet device is decreased.

What is needed, therefore, is an apparatus which can stably adjust air pressure in the ink tank and a ink-supplying system with the same.

SUMMARY

An apparatus for regulating air pressure in an ink tank according to one embodiment is provided. The apparatus includes a vacuum pump configured for providing a pressure below atmospheric pressure in the ink tank. A first regulating unit, a second regulating unit, and a third regulating unit are disposed between the vacuum pump and the ink tank, and in communication with each other. The first regulating unit and the third regulating unit each include a pressure regulating valve and a buffer tank connected with the pressure regulating valve, and the second regulating unit includes a closed-loop pressure regulating valve and a buffer tank connected with the closed-loop pressure regulating valve.

An apparatus for regulating air pressure in an ink tank according to another embodiment is provided. The apparatus includes a vacuum pump configured for providing a pressure below atmospheric pressure in the ink tank. A first regulating unit, a plurality of second regulating units, and a third regulating unit are disposed between the vacuum pump and the ink tank, and in communication with each other. The first regulating unit and the third regulating unit each include a pressure regulating valve and a buffer tank connected with the pressure regulating valve, and the second regulating unit includes a closed-loop pressure regulating valve and a buffer tank connected with the closed-loop pressure regulating valve.

An ink-supplying system according to further another embodiment is provided. The system includes an ink tank for receiving ink therein and a vacuum pump configured for providing a pressure below atmospheric pressure in the ink tank. A first regulating unit, at least one second regulating unit, and a third regulating unit are disposed between the vacuum pump and the ink tank, and in communication with each other. The first regulating unit and the third regulating unit each include a pressure regulating valve and a buffer tank connected with the pressure regulating valve, and the second regulating unit includes a closed-loop pressure regulating valve and a buffer tank connected with the closed-loop pressure regulating valve.

Advantages and novel features will become more apparent from the following detailed description of the present apparatus and its related method, when taken in conjunction with the accompanying drawings.

BRIEF DESCRIPTION OF THE DRAWINGS

Many aspects of the present apparatus and systems can be better understood with reference to the following drawings. The components in the drawings are not necessarily drawn to scale, the emphasis instead being placed upon clearly illustrating the principles of the present apparatus and its related manufacturing method. Moreover, in the drawings, like reference numerals designate corresponding parts throughout the several views.

DETAILED DESCRIPTION OF THE INVENTION

Reference will now be made to the drawings to describe preferred embodiments of the present apparatus and its related manufacturing method, in detail.

Figure 1:
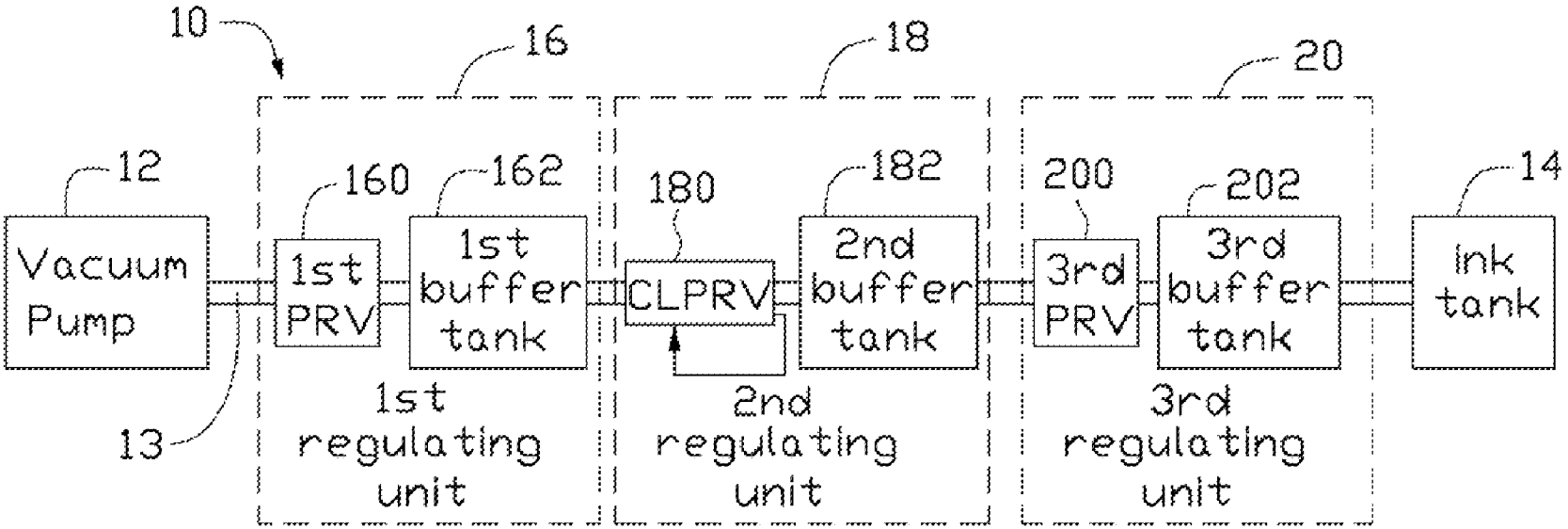
FIG. 1 is a schematic view of an apparatus in accordance with a first preferred embodiment.

Referring to FIG. 1, an apparatus 10 in accordance with a first present embodiment is shown. The apparatus 10 includes a pressure-control source 12 such as a vacuum pump, and an ink tank 14. The pressure-control source 12 communicates with the ink tank 14 by the channel means 13. A first regulating unit 16, a second regulating unit 18, and a third regulating unit 20 are disposed between the pressure-control source 12 and the ink tank 14, in the order between, and communicate with each other by the channel means 13.

The first regulating unit 16 includes a first pressure regulating valve 160 ($1^{st}$ PRV for short) and a first buffer tank 162. The second regulating unit 18 includes a closed-loop pressure regulating valve 180 (CLPRV for short) and a second buffer tank 182. The third regulating unit 20 includes a third pressure regulating valve 200 ($3^{rd}$ PRV for short) and a third buffer tank 202. In the present embodiment, the first pressure regulating valve 160 and the third pressure regulating valve 200 can be manually electromagnetic valves or automatic electromagnetic valves. The closed-loop pressure regulating valve 180 is a programmable logic control (PLC) electromagnetic valve. The first buffer tank 162, the second buffer tank 182, and the third buffer tank 202 can be shaped as hollow cylinders or hollow cubes.

The first regulating unit 16 is disposed between the pressure control source 12 and the second regulating unit 18, and communicates with the pressure control source 12 and the second regulating unit 18 by the channel means 13. The first regulating unit 16 is configured for stabilizing and regulating the air pressure in the ink tank 14. The first pressure regulating valve 160 communicates with the first buffer tank 162. Specifically, the first pressure regulating valve 160 is connected with the pressure-control source 12, and the first buffer tank 162 is connected with the second regulating unit 18.

The second regulating unit 18 is disposed between the first regulating unit 16 and the third regulating unit 20, and communicates with the first regulating unit 16 and the third regulating unit 20 by the channel means 13. The second regulating unit 18 is configured for stabilizing and regulating the air pressure in the ink tank 14 further. The closed-loop pressure regulating valve 180 communicates with the second buffer tank 182. Specifically, the closed-loop pressure regulating valve 180 is connected with the first buffer tank 162 of the first regulating unit 16, and the second buffer tank 182 is connected with the third regulating unit 20.

The third regulating unit 20 is disposed between the second regulating unit 18 and the ink tank 14, and communicates with the second regulating unit 18 and the ink tank 14 by the channel means 13. The third regulating unit 20 is configured for regulating the air pressure in the ink tank according to the pressure the system needed. The third pressure regulating valve 200 communicates with the third buffer tank 202. Specifically, the third pressure regulating valve 200 is connected with the second buffer tank 182 of the second regulating unit 18, and the third buffer tank 202 is connected with the ink tank 14.

Figure 2:
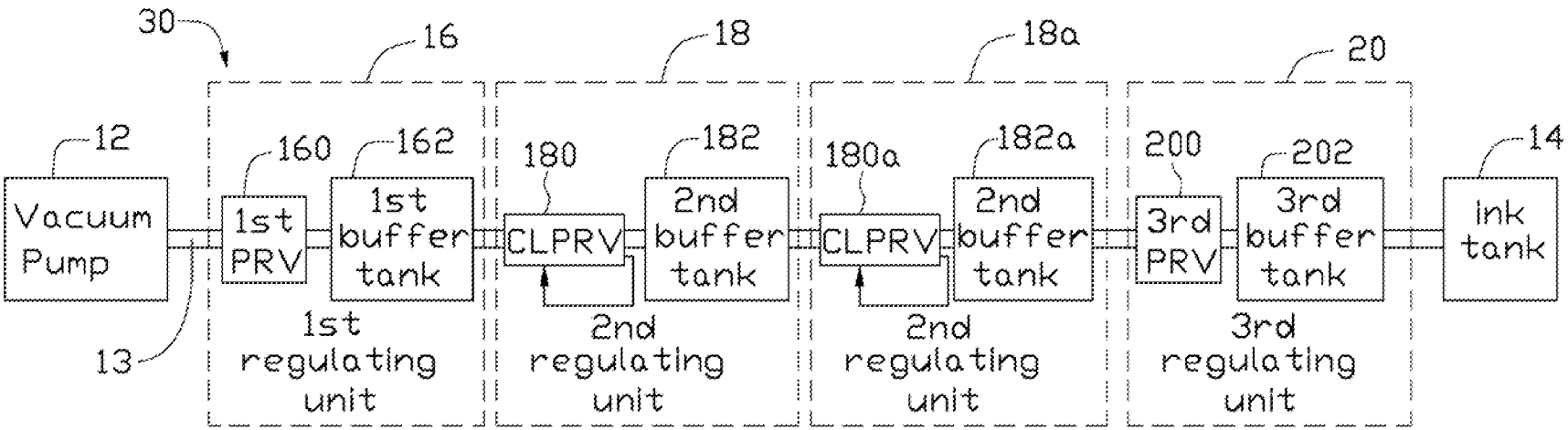
FIG. 2 is a schematic view of an apparatus in accordance with a second preferred embodiment.

With reference to FIG. 2, an apparatus 30 in accordance with a second present embodiment is shown. The apparatus 30 is similar to the apparatus 10 of the first embodiment. The apparatus 30 further includes a plurality of second regulating unit 18*a* configured for stabilizing and regulating the air pressure in the ink tank 14 to a greater degree. The plurality of second regulating unit 18*a* is coupled between the second regulating unit 18 and the third regulating unit 20. The second regulating unit 18*a* is similar to the second regulating unit 18. A closed-loop pressure regulating valve 180*a* communicates with the second buffer tank 182*a*.

A process of regulating the air pressure in the ink tank by the apparatus mentioned above will be described as below.

Firstly, the apparatus 10 as described above is provided, and a predetermined pressure below atmospheric pressure is set to the first pressure regulating valve 160. Then the pressure-control source 12, such as a vacuum pump, is turned on.

Secondly, a pressure force generated by the pressure-control source 12, according to the predetermined pressure, propagates through the first pressure regulating valve 160 and the first buffer tank 162, in the order written, by the channel means 13. The first pressure regulating valve 160 stabilizes the pressure force in the channel means 13. Furthermore, since the first buffer tank 162 provides a big pressure buffer space, the pressure force passing though the first buffer tank 162 becomes more stable.

Thirdly, after being primarily regulated by the first regulating unit 16, the pressure force propagates through the closed-loop pressure regulating valve 180 and the second buffer tank 182 in the order written. Range of the pressure is regulated by the closed-loop pressure regulating valve 180 around the needed range according to the manufacturing process of making a color filter. Because the closed-loop pressure regulating valve 180 is a programmable logic control electromagnetic valve, the closed-loop pressure regulating valve 180 can be real time controlled.

Finally, after being further regulated by the second regulating unit 18, the pressure force propagates through the third pressure regulating valve 200 and the third buffer tank 202 in the order written. The third pressure regulating valve 200 is set to a predetermined value, so that the pressure in the ink tank 14 becomes the pressure the system needed. As a result, the air pressure in the ink tank 14 is maintained in a stable state. A plurality of the second regulating unit 18*a* can be further connected between the second regulating unit 18 and the third regulating unit 20.

The apparatus as describe above uses the first regulating unit 16, the second regulating unit 18, and the third regulating unit 20 to gradual regulate the pressure force generated by the pressure-control source 12. The apparatus can avoid the pressure concussion caused by the pressure-control source 12. As a result, the air pressure in the ink tank 14 can be stably maintained.

It is to be understood that the above-described embodiment is intended to illustrate rather than limit the invention. Variations may be made to the embodiment without departing from the spirit of the invention as claimed. The above-described embodiments are intended to illustrate the scope of the invention and not restrict the scope of the invention.

What is claimed is:

1. An apparatus for regulating air pressure in an ink tank, comprising:

a vacuum pump configured for providing a pressure below atmospheric pressure in the ink tank;

a first regulating unit, a second regulating unit, and a third regulating unit disposed between the vacuum pump and the ink tank, and in communication with each other, wherein the first regulating unit and the third regulating unit each comprise a pressure regulating valve and a buffer tank connected with the pressure regulating valve, and the second regulating unit comprises a closed-loop pressure regulating valve and a buffer tank connected with the closed-loop pressure regulating valve.

2. The apparatus as claimed in claim 1, wherein the pressure regulating valve is a manually electromagnetic valve or an automatic electromagnetic valve.

3. The apparatus as claimed in claim 1, wherein the closed-loop pressure regulating valve is a programmable logic control electromagnetic valve.

4. The apparatus as claimed in claim 1, wherein the buffer tank is a hollow cylinder or a hollow cube-shaped chamber.

5. An apparatus for regulating air pressure in an ink tank, comprising:

a vacuum pump configured for providing a pressure below atmospheric pressure in the ink tank;

a first regulating unit, a second regulating unit, and a third regulating unit disposed between the vacuum pump and the ink tank, and in communication with each other, the second regulating unit being connected between the first regulating unit and the third regulating unit, wherein the first regulating unit and the third regulating unit each comprise a pressure regulating valve and a buffer tank connected with the pressure regulating valve, and the second regulating unit comprises a closed-loop pressure regulating valve and a buffer tank connected with the closed-loop pressure regulating valve.

6. The apparatus as claimed in claim 5, wherein the pressure regulating valve is a manually electromagnetic valve or an automatic electromagnetic valve.

7. The apparatus as claimed in claim 5, wherein the closed-loop pressure regulating valve is a programmable logic control electromagnetic valve.

8. The apparatus as claimed in claim 5, wherein the buffer tank is a hollow cylinder or a hollow cube-shaped chamber.

* * * * *